US008444370B2

(12) United States Patent
Gülich

(10) Patent No.: US 8,444,370 B2
(45) Date of Patent: May 21, 2013

(54) IMPELLER FOR PUMPS

(75) Inventor: Johann Gülich, Villeneuve (CH)

(73) Assignee: Sulzer Pumpen AG, Winterthur (CH)

( * ) Notice: Subject to any disclaimer, the term of this patent is extended or adjusted under 35 U.S.C. 154(b) by 1176 days.

(21) Appl. No.: 10/567,046

(22) PCT Filed: Jul. 5, 2004

(86) PCT No.: PCT/CH2004/000420

§ 371 (c)(1),
(2), (4) Date: May 5, 2008

(87) PCT Pub. No.: WO2005/012732

PCT Pub. Date: Feb. 10, 2005

(65) Prior Publication Data

US 2008/0213093 A1 Sep. 4, 2008

(30) Foreign Application Priority Data

Aug. 4, 2003 (EP) ..... 03405575

(51) Int. Cl.
*F04D 29/30* (2006.01)

(52) U.S. Cl.
USPC ..... 415/1; 415/98

(58) Field of Classification Search
USPC ..... 415/98, 106, 77, 1; 416/182
See application file for complete search history.

(56) References Cited

U.S. PATENT DOCUMENTS

| | | | | | |
|---|---|---|---|---|---|
| 564,897 | A | | 7/1896 | Orton | |
| 1,867,290 | A | | 7/1932 | Vitu | |
| 2,557,201 | A | * | 6/1951 | Punt | 416/184 |
| 2,658,455 | A | * | 11/1953 | Seinfeld | 416/181 |
| 3,478,691 | A | | 11/1969 | Henry, IV | |
| 3,816,020 | A | * | 6/1974 | Ogles | 415/111 |
| 3,944,406 | A | * | 3/1976 | Jagusch et al. | 55/407 |
| 4,060,337 | A | | 11/1977 | Bell, III | |
| 4,278,399 | A | * | 7/1981 | Erickson | 415/199.1 |
| 4,400,136 | A | * | 8/1983 | Seyffert | 415/140 |
| 4,752,187 | A | * | 6/1988 | Hergt et al. | 416/186 R |
| 4,890,980 | A | * | 1/1990 | Heald et al. | 416/181 |
| 4,940,385 | A | * | 7/1990 | Gurth | 415/206 |
| 4,981,413 | A | * | 1/1991 | Elonen et al. | 415/115 |
| 5,019,136 | A | * | 5/1991 | Elonen et al. | 95/261 |
| 5,219,472 | A | * | 6/1993 | Elonen et al. | 210/787 |

FOREIGN PATENT DOCUMENTS

EP 0112462 A1 7/1984

* cited by examiner

*Primary Examiner* — Edward Look
*Assistant Examiner* — Liam McDowell
(74) *Attorney, Agent, or Firm* — Kilpatrick Townsend & Stockton LLP

(57) ABSTRACT

A rotary wheel for radial pumps includes an intermediate wall at which one or more vanes are provided on both sides. Passage openings are formed in the intermediate wall in order to distribute a desired pump flow onto the vanes on both sides of the intermediate wall.

14 Claims, 3 Drawing Sheets

IMPELLER FOR PUMPS

CROSS-REFERENCES TO RELATED APPLICATIONS

This application is a National Stage of International Application No. PCT/CH2004/000420, filed Jul. 5, 2004, and which claims the benefit of European Patent Application No. 03405575.6, filed Aug. 4, 2003, the disclosures of both applications being incorporated herein by reference.

BACKGROUND OF THE INVENTION

The invention relates to an impeller for pumps, in particular for radial pumps, and to a pump, in particular a radial pump with an impeller of this kind, and also to a method for operating a pump of this kind.

In centrifugal pumps with one or more impellers, the resultant of all the axial forces acting on the impeller or the impellers during operation can reach considerable values. Without additional measures this resultant force which is termed axial thrust, would be transferred via the pump shaft to the bearing and would correspondingly put a heavy load on this. Suitable constructional measures are known from the prior art for reducing the axial thrust, for example by means of a dual-flow pump arrangement with a mirror symmetrical design of the impellers, or in single flow pumps by providing sealing gaps on both sides of the impeller and openings in the impeller which connect the suction side with the reverse side of the impeller. A further possibility is to relieve the pump of axial pressure by means of a suitable relief device, such as a relief ring or piston, for example.

For the characterisation of a centrifugal pump impeller the specific rotational speed $n_q$ is often used which is calculated in known manner from the capacity or pump flow Q, head H and rotational speed n. In pumps for small specific rotational speeds $n_q$, of for example smaller than 15 $min^{-1}$, corresponding to a comparatively large head of greater than 50, 75 or 150 m and comparatively small capacities of smaller than 100, 50 or 25 $m^3/h$ for example, in particular in those kinds of process pumps, the problem arises that the above-mentioned measures for the axial thrust compensation can only be applied to a restricted extent. Thus a dual flow version of a pump for small capacities requires a considerable amount of additional cost and complexity in comparison with a single flow design. A balance piston is likewise comparatively costly and for this reason is mainly used in larger multi-stage pumps. For a single stage process pump, sealing gaps are normally provided on both sides of the impeller. An axial thrust compensation by means of sealing gaps on both sides of the impeller and openings in the impeller is, however, only possible when the impellers are closed. In the case of closed impellers with small specific rotational speeds $n_q$ there is the problem of the manufacture, since the outlet widths of impellers of this kind are in the region of few mms and the manufacture of closed impellers with small outlet widths is difficult and expensive from the point of view of casting technology.

A further disadvantage of closed impellers is the high impeller friction losses (also called impeller side friction losses) and clearance gap losses which impellers of this kind have at small specific rotational speeds $n_q$. At a specific rotational speed $n_q$, of 8 $min.^{-1}$ for example, the impeller friction loss alone amounts to 30% or more. Closed impellers for small specific rotational speeds $n_q$ thus show a comparatively low degree of efficiency.

For the above-mentioned reasons, impellers for specific rotational speeds $n_q$ smaller than 10 or 15 $min.^{-1}$ are often designed to be half-open. This has advantages from the point of view of casting technology and the wheel friction of half-open impellers is considerably less than those of closed impellers. Half-open impellers for specific rotational speeds $n_q$ less than 10 or 15 $min.^{-1}$ have the disadvantage however that the axial thrust compensation is difficult and the impeller friction losses are still very high.

An additional problem of closed and half-open impellers for small specific rotational speeds $n_q$ is the tendency to instability in the part load region, i.e. impellers of this kind have a characteristic curve which is either unstable (corresponding to a falling characteristic curve, if the pump flow Q approaches 0) or only just stable (corresponding to a characteristic without a notable rise when Q approaches 0).

BRIEF SUMMARY OF THE INVENTION

The object of the invention is to make available an impeller for pumps, in particular radial pumps, which facilitates a reliable axial thrust compensation even at rotational speeds $n_q$ less than 10 or 15 $min.^{-1}$, which is comparatively economical to manufacture, which shows lower impeller friction losses when compared with a correspondingly dimensioned closed or half-open impeller and which has a stable characteristic curve in the part load region. A further object of the invention is to make available a pump, in particular a radial pump with an impeller of this kind and also a method for operating a pump of this kind.

The impeller for pumps in accordance with the invention, in particular radial pumps, includes one or more vanes and additionally an intermediate wall on which one or more vanes are provided on both sides respectively. At least one passage opening is formed in the intermediate wall in order to distribute a desired pump flow to the vanes on both sides of the intermediate wall. The impeller preferably has a suction side which, in the inbuilt state of the impeller, is directed towards a suction opening of the pump and the vanes are preferably connected on the side of the intermediate wall directed away from the suction side to the suction side via at least one passage.

In a preferred embodiment the impeller has a hub and a plurality of passage openings in a region of the impeller adjacent to the hub. In a further preferred embodiment the impeller is open towards the suction side or towards both sides. The vanes preferably include shortened vanes, so-called splitter vanes. The impeller preferably has a specific rotational speed $n_q$ in the region of 2-20 $min.^{-1}$, in particular in the region of 5-12 $min.^{-1}$.

The outlet edges of the vanes on the suction side and/or on the side of the intermediate wall remote from the suction side are chamfered. A chamfer of the vanes at the suction side which falls away towards the suction side is advantageous, while the vanes on the side of the intermediate wall remote from the suction side have outlet edges parallel to the axis. The chamfering of the vane outlet edges supports an ordered circulation which is particularly advantageous in the part load region.

The vanes on both sides of the intermediate wall are preferably so designed that, at part load, an ordered circulation occurs and the impeller has a characteristic curve which rises constantly, in particular rises constantly and clearly if the pump flow Q approaches 0. For this purpose the vanes are preferably designed differently on both sides of the intermediate wall, for example in that the vanes on both sides of the intermediate wall have different chamfers of the outlet edges and/or different vane outlet angles and/or different numbers of vanes.

The invention further includes a pump, in particular a radial pump with an impeller in accordance with the above description.

In the method according to the invention for the operation of a pump, in particular a radial pump with at least one impeller, the impeller additionally provided with an intermediate wall on which one or more vanes are provided on both sides and with at least one passage connecting the two sides. In the method according to the invention a desired pump flow is distributed over the vanes on both sides of the intermediate wall, preferably by a part of the pump flow being fed through the at least one passage opening from one side of the intermediate wall to the other side.

The impeller in accordance with the invention has the advantage that the division of the pump flow over the vanes on both sides of the intermediate wall makes a reliable axial thrust compensation possible. Furthermore, the impeller is distinguished by a stable characteristic curve and a stable part load behaviour. In the open form, the impeller in accordance with the invention facilitates a good rotor efficiency, since the wheel friction which accounts for a large part of the losses, in particular in impellers with low specific rotational speeds, is dispensed with. Thanks to the open form, vane output widths of a few mms are very easy to manufacture by means of casting and/or milling for example. The division of the pump flow over the vanes on both sides of the intermediate wall results in a reduced vane width which has a favourable effect on the casting properties and the natural frequency of the vanes. If needed the vane thickness can be reduced in comparison with a traditional impeller with the same pump head and the same capacity.

Further advantageous embodiments can be seen from the dependent claims and the drawings.

BRIEF DESCRIPTION OF THE DRAWINGS

The invention will be explained in more detail with reference to the embodiments and with the help of the drawings, in which.

DETAILED DESCRIPTION OF THE DRAWINGS

Figure 1A:
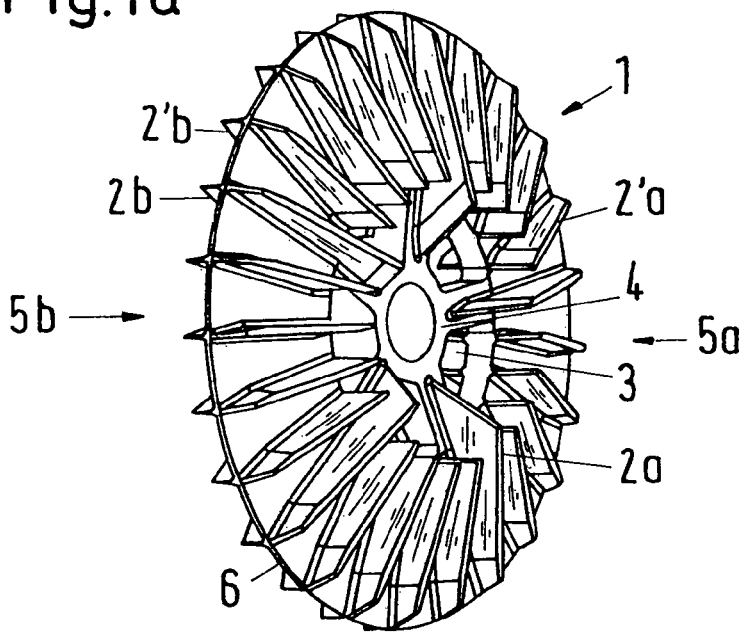
FIG. 1*a* is a perspective view of an embodiment of an impeller in accordance with the present invention.
Figure 1B:
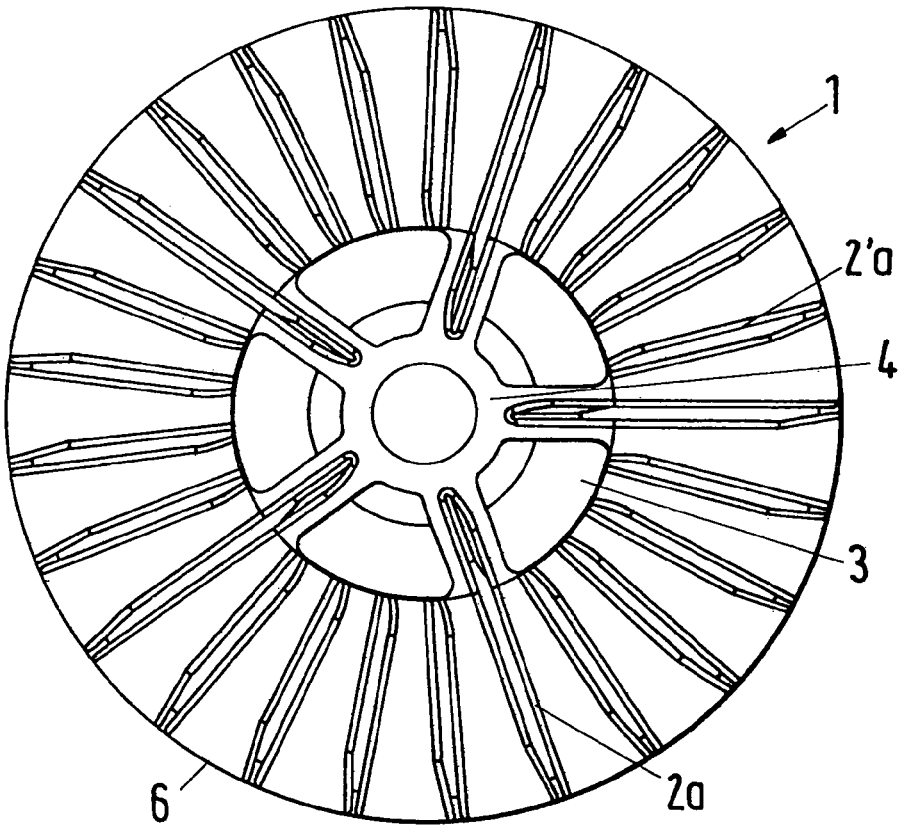
FIG. 1*b* is a front view of the impeller shown in FIG. 1*a*.

FIGS. 1*a* and 1*b* show an embodiment of an impeller for pumps, in particular radial pumps in accordance with the present invention. The impeller 1 of the embodiment includes a hub 4, an intermediate wall 6, on which one or more vanes 2*a*, 2'*a*, 2*b*, 2'*b* are provided on both sides respectively as well as a passage 3 which, as shown in the FIGS. 1*a* and 1*b*, is formed in the shape of five passage openings in order to distribute a desired pump flow over the vanes 2*a*, 2'*a*, 2*b*, 2'*b* on both sides of the intermediate wall. In the embodiment the passage openings are formed in one region of the impeller adjacent to the hub 4. It goes without saying that other designs of the passage opening 3 are also possible. The impeller 1 expediently has a suction side 5*a* which, in the inbuilt condition of the impeller, is directed towards a suction opening of the pump and the vanes 2*b*, 2'*b* on the side of the intermediate wall remote from the suction side are connected with the suction side 5*a* via the passage opening 3, i.e. via the five passage openings in the example shown.

In the embodiment the impeller 1 is open towards both sides. It is however also possible that the impeller is only open on one side, the suction side 5*a* for example or is, if necessary, also closed. In the embodiment shortened vanes 2'*a*, 2'*b*, so-called splitter vanes are provided between the passage openings. In one embodiment the vane edges are chamfered at the outlet. In the variant shown in the FIGS. 1*a* and 1*b*, the vane outlet edges are double chamfered at the suction side 5*a*, firstly they have a chamfer towards the suction side 5*a* (the outlet edge is inclined to the axis) and additionally a profile (taper) on the pressure side. If necessary, as shown in FIGS. 1*a* and 1*b*, the vane inlet edges on the suction side 5*a* can be provided with a profile on the suction side. It is of course also possible to chamfer the vane outlet edges on the side 5*b* remote from the suction side or to provide a common chamfer for both sides jointly and also to provide blade outlet edges parallel to the axis on one or both sides.

In the embodiment all the vanes 2*a*, 2'*a*, 2*b*, 2'*b* extend straight ahead in the radial direction towards the outside. The vane inlet angle and the vane outlet angle thus amount to 90° in a first approximation. The actual vane outlet angle on the suction side 5*a* is slightly smaller than 90° as a result of the profile of the vane outlet edge on the pressure side. It is however also possible to provide curved vanes with a vane outlet angle smaller or greater than 90°. The vane inlet angle is advantageously smaller than the vane outlet angle and preferably smaller than or the equal to 90°. The vanes 2*a*, 2'*a*, 2*b*, 2'*b* advantageously have a vane inlet width, at least at one side, preferably at the suction side 5*a*, which is larger than the vane outlet width. The vane outlet widths on the suction side 5*a* and the side 5*b* remote from the suction side are expediently designed in such a way that a good suction capability is obtained. The ratio of the vane widths on the suction side 5*a* and on the side 5*b* remote from the suction side can be selected within wide limits. In a typical embodiment the vane widths on both sides are approximately the same size.

In a preferred embodiment the impeller 1 has a specific rotational speed $n_q$ in the range of 2-20 $min.^{-1}$, preferably in the range of 7-12 $min^{-1}$.

Figure 2:
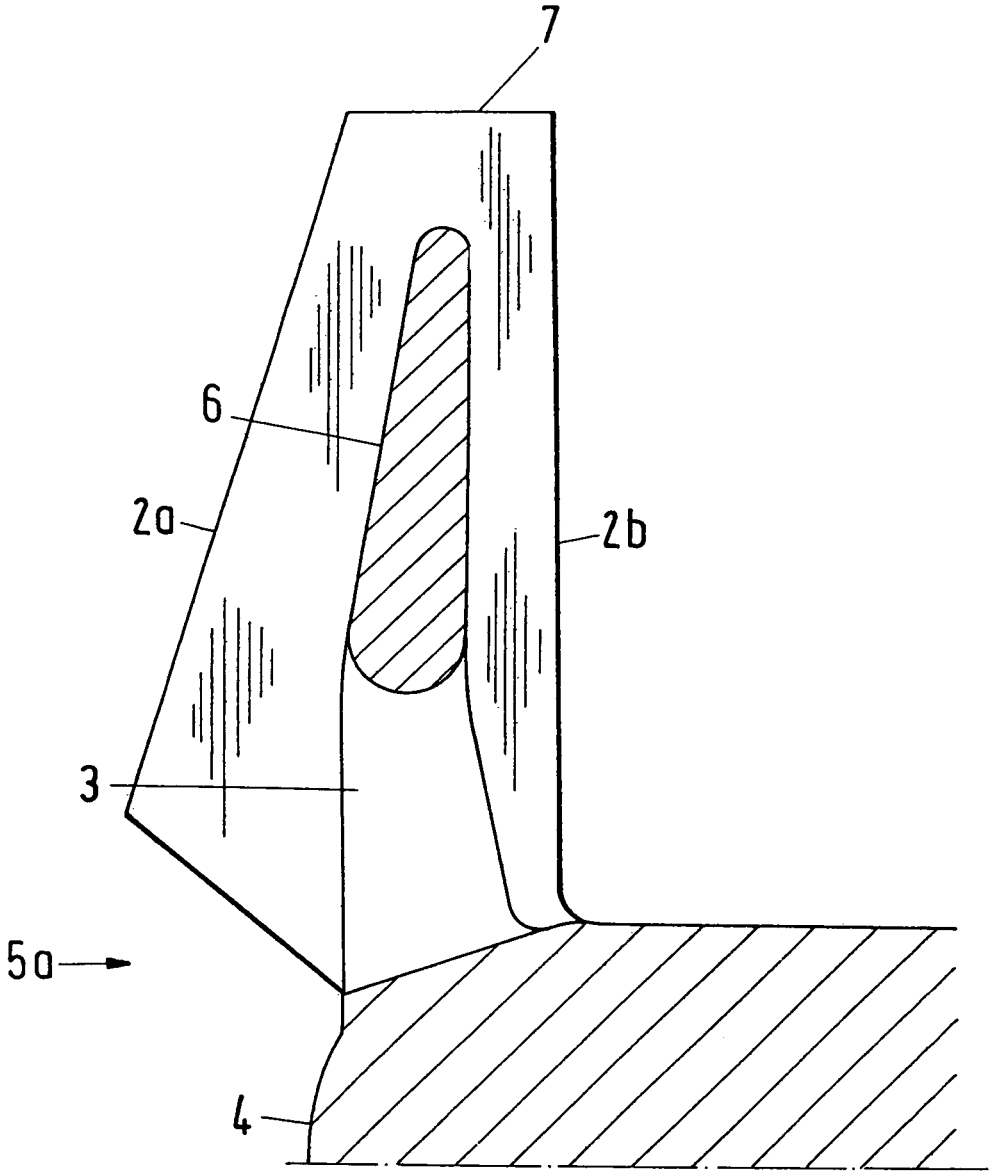
FIG. 2 is a cross-sectional view of an alternative embodiment of an impeller in accordance with the present invention with a shortened intermediate wall.

In the embodiment shown in FIG. 2, the impeller includes an intermediate wall 6, the outer diameter of which is smaller than the outer diameter of the impeller. On each side of the intermediate wall 6 there are respective vanes 2*a*, 2*b* which join at the outer end so that the two vanes have a common outlet edge 7. The intermediate wall 6 and the vanes 2*a*, 2*b* are arranged on a hub 4. A passage opening 3 is additionally formed in a region of the impeller adjacent to the hub 4 which connects the two sides of the intermediate wall 6 in a fluid conducting manner. Since the intermediate wall 6 in this embodiment only extends over a part of the vane length, the intermediate wall can also be termed an intermediate bridge if desired.

Figure 3:
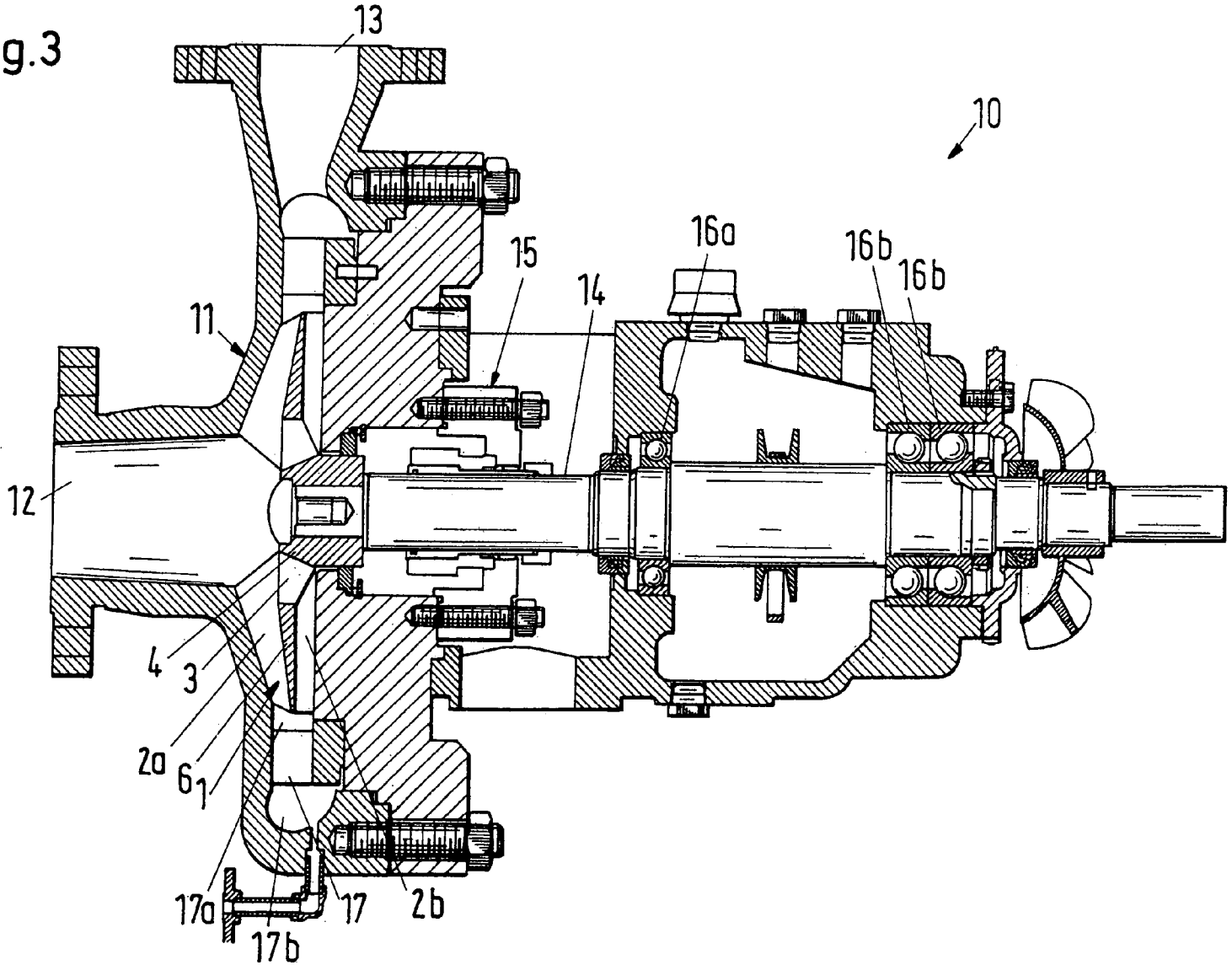
FIG. 3 is a cross-sectional view of a process pump with an impeller in accordance with the present invention.

FIG. 3 shows an embodiment of a pump, preferably a process pump with a rotor in accordance with the present invention. The pump 10 of the present embodiment includes an impeller 1, for example an open impeller in accordance with the above-described embodiment, with a hub 4, an intermediate wall 6 on which vanes 2*a*, 2*b* are provided on both sides and with a passage opening 3, in order to distribute a desired pump flow over the vanes 2*a*, 2*b* on both sides of the intermediate wall 6. The pump 10 further includes a housing 11, an inlet or suction opening 12, a ring channel 17*a* which adjoins the outside of the impeller 1, a diffuser insert 17 and an annular cavity 17*b* which opens out into an outlet or pressure connection 13. By means of a modified insert 17, a spiral or an annular cavity can be produced which is directly connected to the outlet or pressure connection or stub 13. By adapting the diffuser insert it is possible to compensate for the generally considerable radial thrust in pumps with low specific rotary speeds. A cast housing without an exchangeable insert can of course also be used as a guide mechanism.

The pump further includes a shaft 14, a shaft seal 15, for example a stuffing box and bearings 16*a*, 16*b* for supporting the shaft. In the embodiment the bearings 16*a*, 16*b* are designed as ball bearings which apart from radial forces, can also take up axial forces, depending on the design. In FIG. 3 the bearings 16*b* on the right-hand side of the drawing are specially constructed to take up radial and axial forces for example, so that any eventually present, not completely compensated residual component of the axial thrust can be taken up without any problem.

In a preferred embodiment of the method in accordance with the invention for the operation of a pump, for example a pump in accordance with the embodiment described above, with at least one impeller, the impeller is additionally provided with an intermediate wall 6 at which one or more vanes 2*a*, 2*b* are provided on both sides and with a passage opening 3 which connects the two sides of the intermediate wall 6 in a fluid conducting manner. In this embodiment of the method in accordance with the invention a desired pump flow is distributed over the vanes 2*a*, 2*b* on both sides of the intermediate wall 6, in that a part of the pump flow, 5% to 75% for example and preferably approximately 50% is fed from one side of the intermediate wall 6 to the other side. The pump flow of the impeller 1 is advantageously distributed onto the vanes 2*a*, 2*b* on both sides in such a way that the axial thrust is compensated. The above-described embodiment of the method in accordance with the invention can be used in one-stage pumps and also in multi-stage pumps.

The impeller in accordance with the invention has the advantage that the distribution of the pump flow on the vanes on both sides of the intermediate wall facilitates a simple, and practically complete axial thrust compensation. The above-described impeller is distinguished further by a stable characteristic curve and good efficiency. The impeller in accordance with the invention can be used in one-stage pumps and also in multi-stage pumps.

The invention claimed is:

1. An impeller for a pump, comprising:

an intermediate wall defining a first side at a first axial end thereof configured to be disposed at a suction side of the pump, and a second side at a second axial end thereof configured to be disposed at an opposite side of the pump; and a plurality of vanes provided on both sides of the intermediate wall, the vanes being substantially straight and extending in a substantially radial direction, the vanes comprising longer vanes and shorter vanes, wherein both the longer and shorter vanes are disposed on both sides of the intermediate wall;

wherein the intermediate wall defines at least one passage opening therein, configured to distribute a desired pump flow to the vanes on both sides of the intermediate wall; and wherein the impeller is open towards the suction side.

2. The impeller in accordance with claim 1, wherein the vanes on the second side of the intermediate wall are connected to the suction side via the at least one passage opening.

3. The impeller in accordance with claim 1, further comprising a hub wherein the at least one passage opening comprises a plurality of passage openings disposed adjacent to the hub.

4. The impeller in accordance with claim 1, wherein at least some of the vanes comprise chamfered vane outlet edges.

5. The impeller in accordance with claim 4, wherein the vanes on the first side are shortest in the radial direction, and wherein the vanes on the second side have outlet edges parallel to an axis of the impeller.

6. The impeller in accordance with claim 1, wherein the vanes are configured such that in the case of part load, an ordered circulation occurs and the impeller has a characteristic curve which rises constantly.

7. The impeller in accordance with claim 6, wherein the characteristic curve rises constantly and clearly when the pump flow approaches 0.

8. The impeller in accordance with claim 6, wherein the vanes on the first side are configured differently than the vanes on the second side.

9. The impeller in accordance with claim 8, wherein the vanes on the two sides of the intermediate wall have different chamfers of outlet edges of the vanes and/or different numbers of vanes.

10. The impeller in accordance with claim 1, wherein the impeller has a specific rotational speed in the region of 2-20 $min.^{-1}$.

11. The impeller in accordance with claim 10, wherein the impeller has a specific rotational speed in the region of 5-12 $min.^{-1}$.

12. A radial pump, defining a suction side and an opposite side, and comprising:

an impeller, comprising:

an intermediate wall defining a first side at a first axial end thereof, and a second side at a second axial end thereof, wherein the first side is disposed at the suction side of the pump, and the second side is disposed at the opposite side of the pump; and a plurality of vanes provided on both sides of the intermediate wall, the vanes being substantially straight and extending in a substantially radial direction, the vanes comprising longer vanes and shorter vanes, wherein both the longer and shorter vanes are disposed on both sides of the intermediate wall;

wherein the intermediate wall defines at least one passage opening therein, configured to distribute a desired pump flow to the vanes on both sides of the intermediate wall; and wherein the impeller is open towards the suction side.

13. A method of operating a radial pump comprising an impeller comprising an intermediate wall defining a first side at a first axial end thereof, and a second side at a second axial end thereof, wherein the first side is disposed at a suction side of the pump and the second side is disposed at an opposite side of the pump, and a plurality of vanes provided on both sides of the intermediate wall, the vanes being substantially straight and extending in a substantially radial direction, the vanes comprising longer vanes and shorter vanes, wherein both the longer and shorter vanes are disposed on both sides of the intermediate wall, wherein the intermediate wall defines at least one passage therein which connects the two sides, comprising:

configuring the impeller to be open towards the suction side; and distributing a desired pump flow onto the vanes on both sides of the intermediate wall.

14. The method in accordance with claim 13, wherein the distributing comprises feeding one part of the pump flow through the at least one passage from the first side of the intermediate wall to the second side.

* * * * *